US011428043B2

(12) United States Patent
Chuang

(10) Patent No.: US 11,428,043 B2
(45) Date of Patent: Aug. 30, 2022

(54) WINDOW SHADE

(71) Applicant: Shan-Chi Chuang, New Taipei (TW)

(72) Inventor: Shan-Chi Chuang, New Taipei (TW)

( * ) Notice: Subject to any disclaimer, the term of this patent is extended or adjusted under 35 U.S.C. 154(b) by 182 days.

(21) Appl. No.: 16/870,934

(22) Filed: May 9, 2020

(65) Prior Publication Data

US 2021/0293086 A1 Sep. 23, 2021

(30) Foreign Application Priority Data

Mar. 18, 2020 (TW) ..... 109203084

(51) Int. Cl.
*A47H 23/02* (2006.01)
*E06B 9/36* (2006.01)

(52) U.S. Cl.
CPC ..... *E06B 9/367* (2013.01); *A47H 2023/025* (2013.01)

(58) Field of Classification Search
CPC . E06B 9/367; E06B 9/38; E06B 9/388; A47H 23/00; A47H 23/01; A47H 23/02; A47H 23/04; A47H 2023/025; A47H 13/00; A47H 13/01
See application file for complete search history.

(56) References Cited

U.S. PATENT DOCUMENTS 303,332 A * 8/1884 Snell ..... A47H 23/01 160/349.1
1,757,017 A * 5/1930 Matovitz ..... A47H 23/01 160/392
1,766,905 A * 6/1930 Jackson ..... A47H 23/01 160/391
1,780,556 A * 11/1930 Kallin ..... E06B 9/42 160/394
1,780,913 A * 11/1930 Golden ..... E06B 9/42 160/387
1,782,905 A * 11/1930 Mohun ..... A47H 23/01 160/387
1,909,109 A * 5/1933 Kopfstein ..... E06B 9/42 160/384
1,934,103 A * 11/1933 Traut ..... E06B 9/17046 160/31
2,255,581 A * 9/1941 Ewing ..... A47G 5/00 160/392
2,350,235 A * 5/1944 Johnson ..... E06B 9/42 160/387
2,350,236 A * 5/1944 Johnson ..... E06B 9/42 160/398
2,361,785 A * 10/1944 Mohun ..... E06B 9/42 160/238

(Continued)

*Primary Examiner* — Johnnie A. Shablack
(74) *Attorney, Agent, or Firm* — Che-Yang Chen; Law Office of Michael Chen

(57) ABSTRACT

A window shade may include a shade, a sliding base, a weight track, a first blocking unit, and two second blocking units. The shade has two mount bars respectively formed at an upper end and a lower end thereof, and the shade is connected to the sliding base and the weight track through the two mount bars. The position of the sliding base is limited by the first blocking unit while the second blocking units are configured to limit the position of the weight track. With the first blocking unit and the two second blocking units, the shade can be replaced easily, and also the structural stability of the window shade is improved.

6 Claims, 9 Drawing Sheets

(56) References Cited

U.S. PATENT DOCUMENTS 2,389,593 A * 11/1945 Cadieux ..... A47H 23/02 160/100
2,466,648 A * 4/1949 Thexton ..... E06B 9/78 160/386
3,298,425 A * 1/1967 Cayton ..... E06B 9/367 160/176.1 V
3,348,603 A * 10/1967 Ford ..... E06B 3/4609 160/197
3,524,491 A * 8/1970 Olson ..... A47H 23/01 160/393
3,911,991 A * 10/1975 Malferrari ..... A47H 23/00 160/202
4,357,978 A * 11/1982 Keller ..... E06B 9/17046 160/271
4,393,915 A * 7/1983 Olson ..... E06B 9/17046 160/384
4,525,946 A * 7/1985 Olson ..... E06B 9/60 160/298
5,109,910 A * 5/1992 Tortorella ..... A47H 15/04 160/197
5,226,468 A * 7/1993 Lord ..... A47H 13/00 160/399
5,657,808 A * 8/1997 Lin ..... A47H 13/00 160/330
5,862,851 A * 1/1999 Stoebich ..... E06B 9/56 160/121.1
6,050,322 A * 4/2000 Finkelstein ..... A47H 1/04 160/178.1 R
6,357,507 B1 * 3/2002 Stoebich ..... A62C 2/10 160/121.1
6,802,357 B2 * 10/2004 Taylor ..... F16B 5/0028 160/371
6,892,783 B1 * 5/2005 Comeau ..... A47H 1/08 160/126
7,174,944 B1 * 2/2007 Clark ..... E05D 15/063 160/197
7,299,852 B1 * 11/2007 Chuang ..... A47H 15/04 160/197
7,360,573 B2 * 4/2008 Yu ..... E06B 9/38 160/178.1 R
8,016,013 B2 * 9/2011 Horvath ..... E06B 9/54 160/23.1
8,695,193 B2 * 4/2014 Kress ..... A47H 99/00 29/414
9,115,533 B2 * 8/2015 Ng ..... E06B 9/42
9,631,409 B2 * 4/2017 Wang ..... E05D 15/0639
9,976,346 B2 * 5/2018 Ng ..... E06B 9/42
D845,513 S * 4/2019 Bowman ..... D25/48.4
10,743,698 B1 * 8/2020 Chen ..... A47H 1/08
11,060,346 B2 * 7/2021 Chuang ..... A47H 1/04
2005/0103451 A1 * 5/2005 Nien ..... E06B 9/388 160/173 R
2007/0158036 A1 * 7/2007 Lin ..... A47H 23/05 160/197
2007/0215297 A1 * 9/2007 Lin ..... A47H 1/04 160/332
2008/0156951 A1 * 7/2008 Lin ..... A47H 1/104 248/261
2009/0050280 A1 * 2/2009 Morris ..... A47H 23/04 160/345
2009/0205791 A1 * 8/2009 Sans Folch ..... A47H 13/04 160/368.1
2010/0071857 A1 * 3/2010 Hung ..... E06B 9/362 160/97
2011/0030169 A1 * 2/2011 Aebi ..... E06B 9/362 16/87.4 R
2011/0272104 A1 * 11/2011 Dimitrakoudis ..... E06B 9/36 160/188
2012/0000617 A1 * 1/2012 Chu ..... E06B 9/24 160/349.1
2012/0061034 A1 * 3/2012 Ng ..... E06B 9/17046 160/290.1
2019/0218857 A1 * 7/2019 Chuang ..... A47H 23/02
2020/0256123 A1 * 8/2020 Chuang ..... E06B 9/326
2021/0007528 A1 * 1/2021 Chuang ..... A47H 23/05
2021/0293086 A1 * 9/2021 Chuang ..... E06B 9/367
2021/0310299 A1 * 10/2021 Chiquin ..... E06B 9/42

* cited by examiner

WINDOW SHADE

FIELD OF THE INVENTION

The present invention relates to a window shade and more particularly to a reliable window shade that is easy to install.

BACKGROUND OF THE INVENTION

A conventional window shade comprises a plurality of window curtains and a slide way, and each of the window curtains is slidably arranged on the slide way through a slide base so as to achieve the shading effect.

However, the conventional window shade has following disadvantages: (i) generally, the window curtain and the slide base are attached together through touch fasteners, and although the attachment process is quick and convenient, the attachment will become not solid after long period and the window curtain is prone to fall off, thereby causing accident. Therefore, there remains a need for a new and improved design for a window shade to overcome the problems presented above.

SUMMARY OF THE INVENTION

The present invention provides a window shade which comprises a shade, a sliding base, a weight track, a first blocking unit, and two second blocking units. Each of an upper end and a lower end of the shade has a mount bar, and a lateral side of the sliding base comprises a first locating groove. A shade groove is formed at a bottom portion of the sliding base, and the shade groove is located under the first locating groove, and the mount bar on the upper end of the shade is adapted to be coupled in the shade groove. The weight track is an elongated board having U-shape cross-section, and a connecting space is formed therein, and the mount bar on the lower end of the shade is configured to be coupled in the connecting space. Each of two ends of the connecting space has a locating hole formed at a bottom portion thereof. The first blocking unit comprises a connecting block and a first block, and an end of the connecting block is coupled in the first locating groove while the other end thereof comprises a first engaging portion. A connecting channel penetrates the first block from one end to the other end, and an outer end of the connecting channel, which is located far from the sliding base than an inner end thereof, comprises a first groove, and a stepped second engaging portion is formed between the connecting channel and the first groove. The connecting block is coupled with the first block, and the first engaging portion is slidably coupled in the connecting channel, and the first block is adapted to have vertical movement relative to the first engaging portion through the connecting channel, so as to enable the first block to block or unblock the shade groove at an end thereof. Each of the second blocking units comprises a cover and a cover board, and one side of the cover is concaved to form a covering space. The two covering spaces are respectively disposed and coupled on two ends of weight track. Each of the covers comprises a through slot at the side opposed to the covering space, and the through slot is communicated with the covering space. The cover board comprises an engaging rib and a locating protrude which respectively protrude from a lateral side of the cover board, and an end of the engaging rib has an engaging bolt protruding from a bottom portion thereof. The engaging rib and the locating protrude are respectively coupled in and movable along the through slot, and the engaging rib is further inserted into the covering space. The engaging bolt is engaged with the locating hole of the weight track, so as to secure the cover on the weight track.

In one embodiment, an end of the first engaging portion has a first blocking portion, and the first engaging portion comprises a second blocking portion separated from the first blocking portion, and a second locating groove is formed between the first blocking portion and the second blocking portion; the thickness of the second locating groove is smaller than that of the first blocking portion and that of the second blocking portion; the connecting block is connected to the first block, and the first blocking portion is adapted to pass through the connecting channel and engage with the second engaging portion at an outer side of the first block, and the second blocking portion is abutted against an inner side of the first block, and the second locating groove is limited in the connecting channel.

In another embodiment, an outer wall of the first block comprises an uneven rough portion to facilitate a user to pull the first block up and down.

In still another embodiment, the elongated weight track has U-shape cross-section, and each of two lateral sides of the weight track comprises an abutting portion, and a top end of the abutting portion is bent inwardly into an inverted U-shaped, and an inner leg of the inverted U is formed into a locating board, and each of the two locating boards is sloped from top to bottom to enable two ends of the two locating boards close to each other; each of buffering spaces is formed between the locating board and the abutting portion to enable the abutting portion to slightly expand outwardly, and the end of the locating board is bent to form a clamping portion.

In a further embodiment, the through slot has two symmetric lateral walls therein, and two protruding portions are respectively formed on the two lateral walls of the through slot.

In still a further embodiment, the end of the engaging rib is tapered to form a third engaging portion, and a third locating groove is formed between the third engaging portion and the cover board.

Comparing with conventional window shade, the present invention is advantageous because: with the first blocking unit and the two second blocking units, the shade can be replaced easily, and also the structural stability of the window shade is improved.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
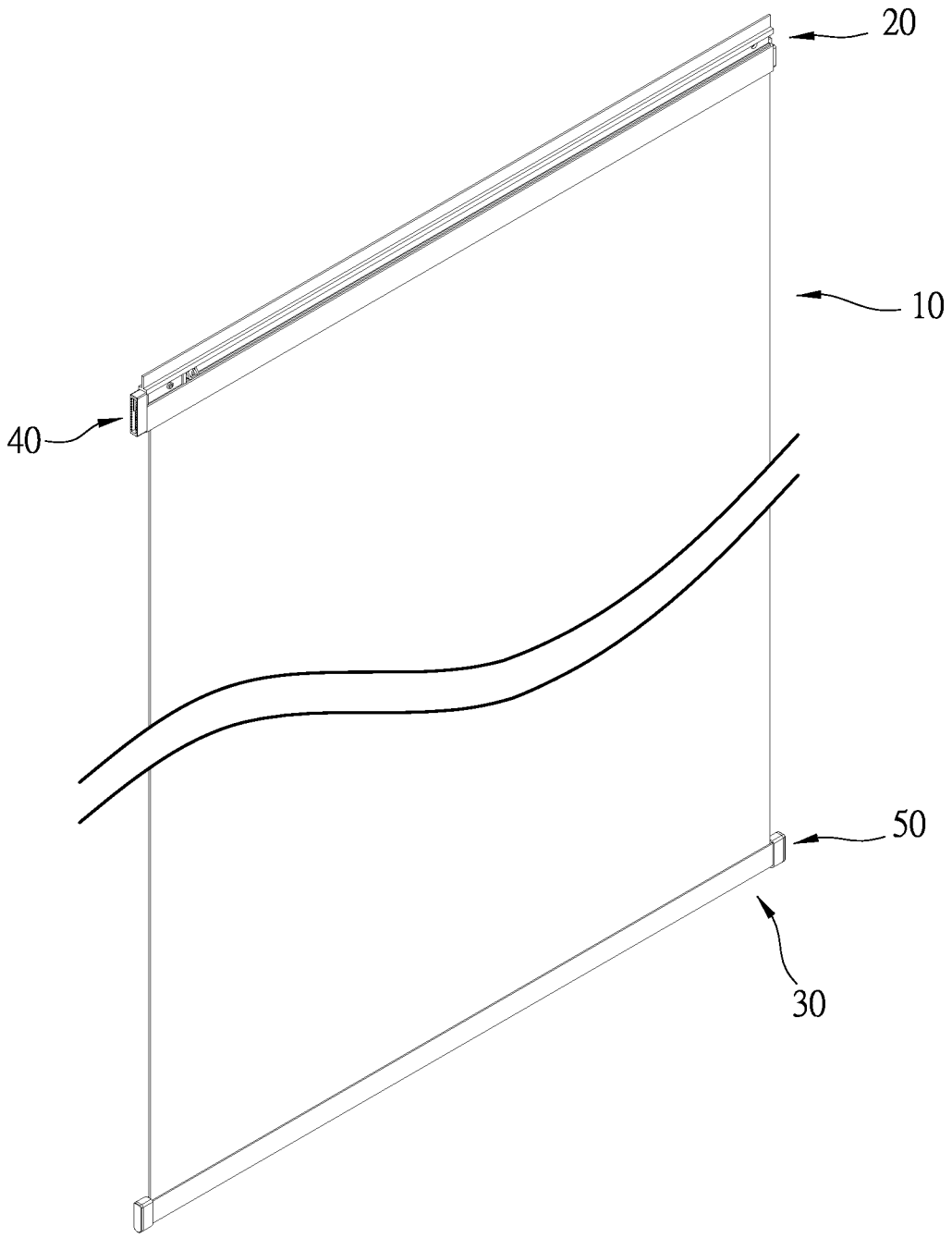
FIG. 1 is a three-dimensional assembly view of a window shade of the present invention.
Figure 2:
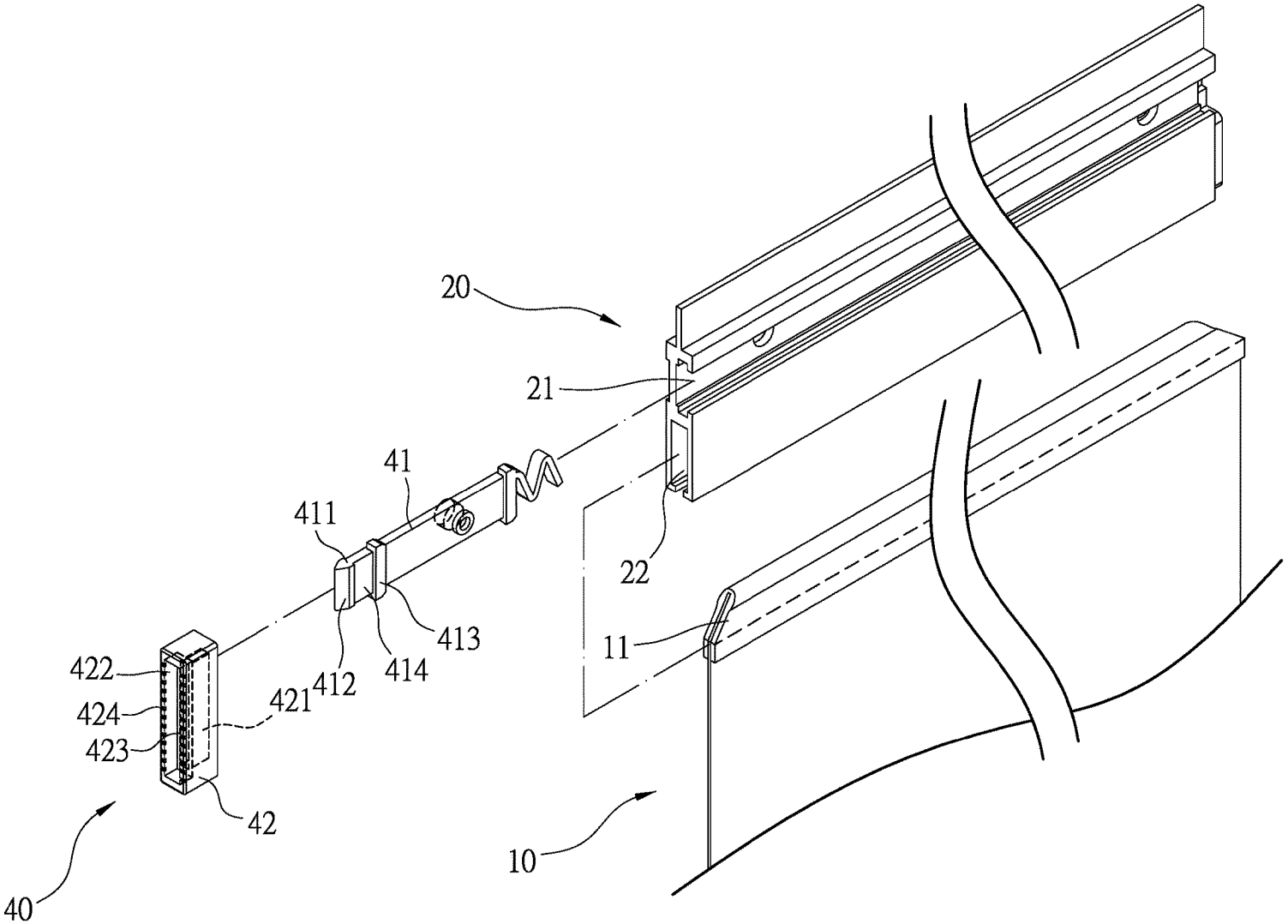
FIG. 2 is an exploded view of an upper portion of the window shade of the present invention.
Figure 3:
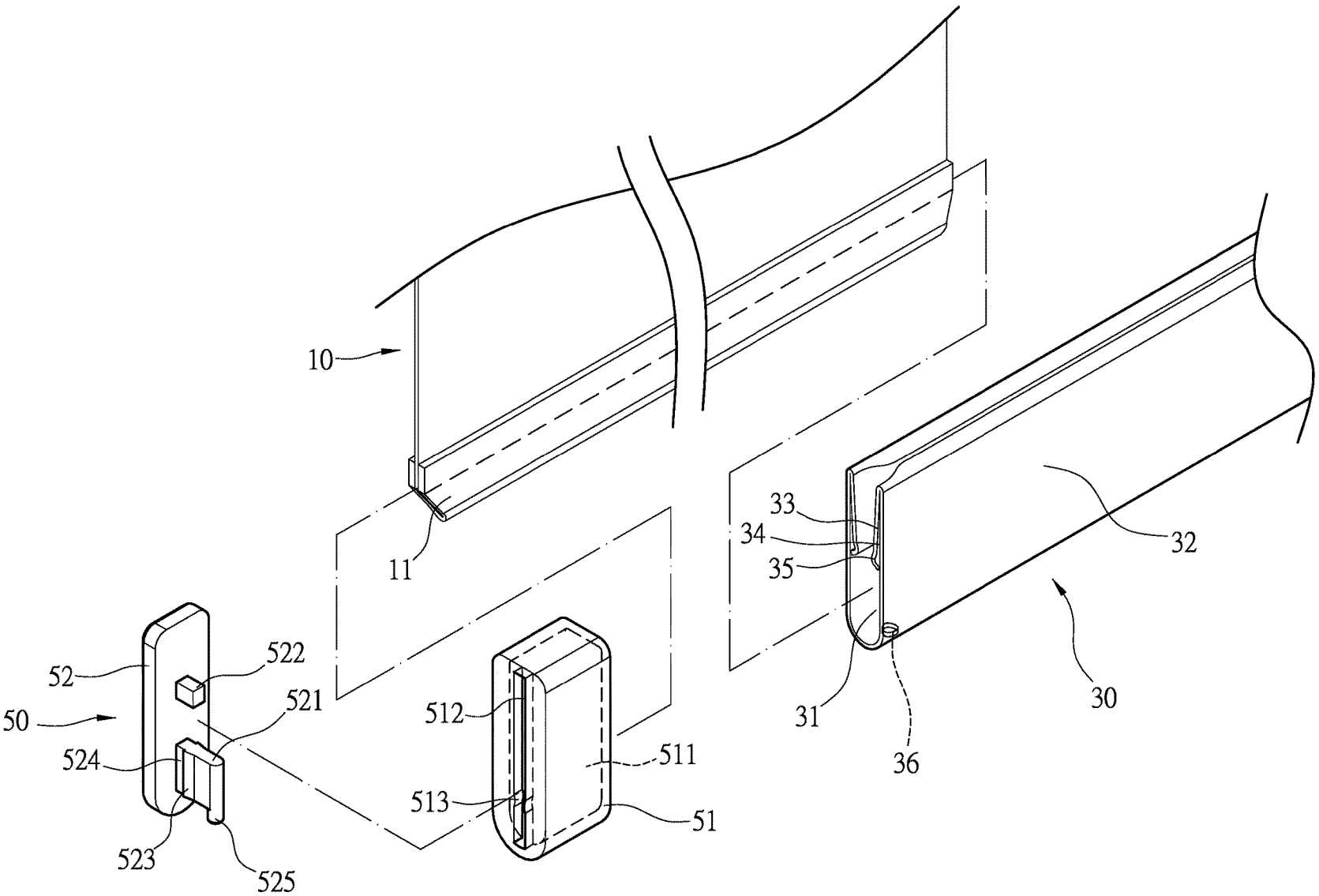
FIG. 3 is an exploded view of a lower portion of the window shade of the present invention.
Figure 4:
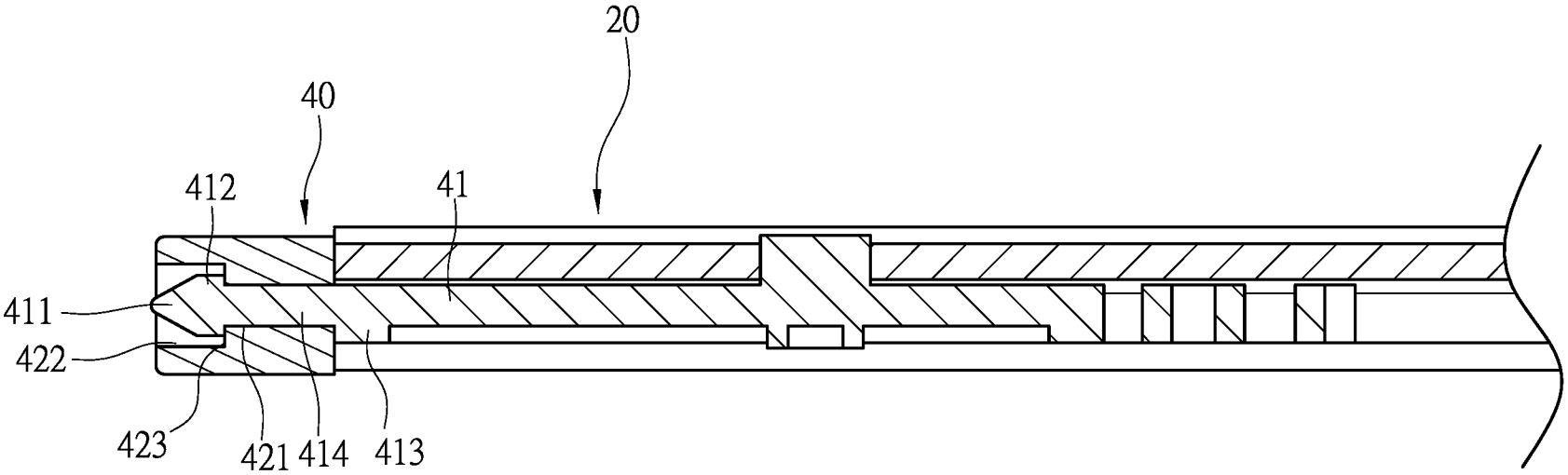
FIG. 4 is a sectional assembly view of the upper portion of the window shade of the present invention.
Figure 5:
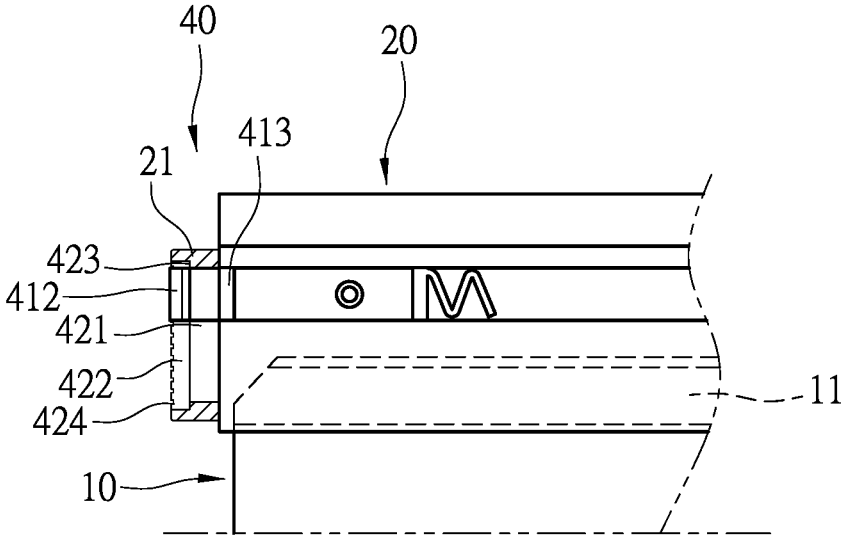
FIG. 5 is a partial sectional assembly view of the upper portion of the window shade of the present invention.
Figure 6:
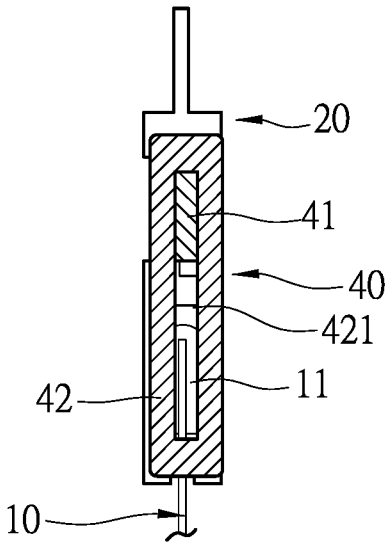
FIG. 6 is a sectional assembly view from another angle of the upper portion of the window shade of the present invention.
Figure 7:
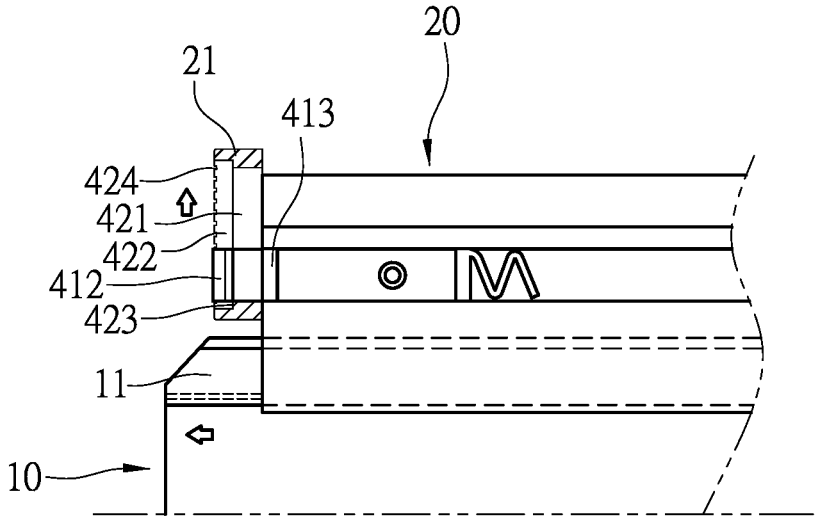
FIG. 7 is a partial sectional disassembly view of the upper portion of the window shade of the present invention.
Figure 8:
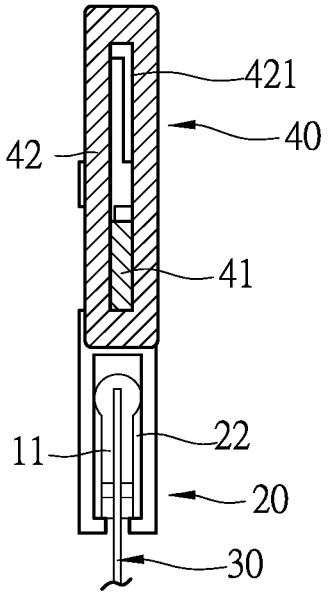
FIG. 8 is a partial sectional disassembly view from another angle of the upper portion of the window shade of the present invention.
Figure 9:
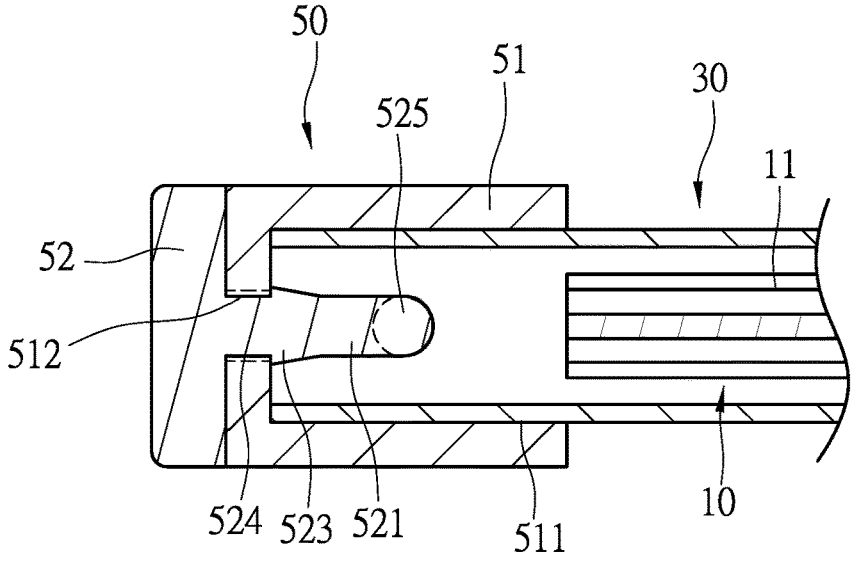
FIG. 9 is a sectional assembly view of the lower portion of the window shade of the present invention.
Figure 10:
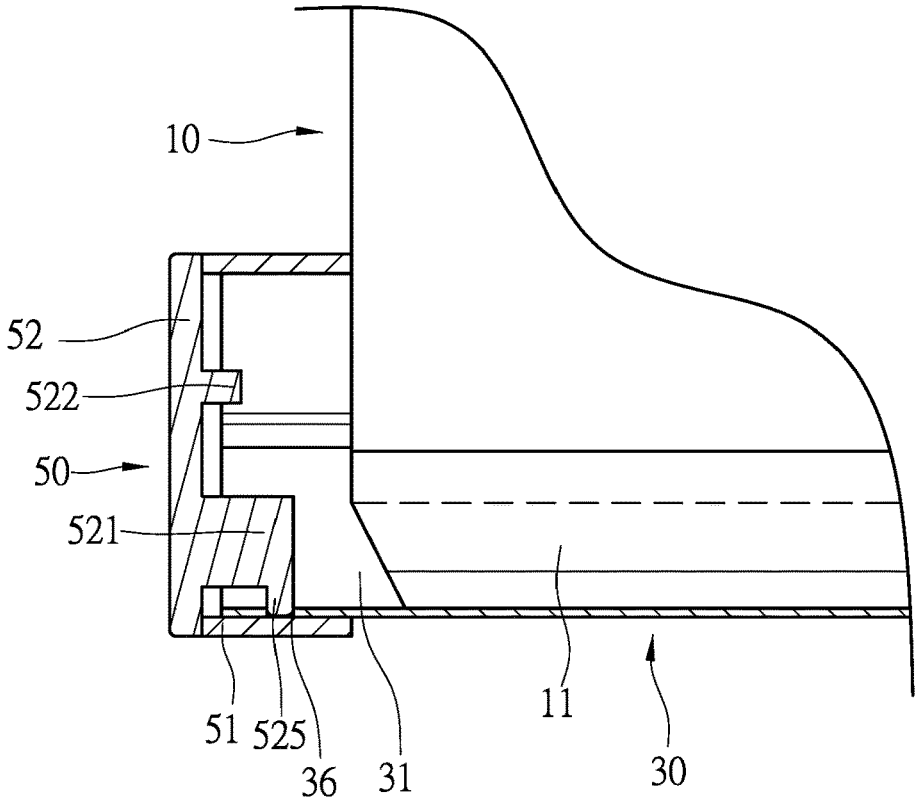
FIG. 10 is a sectional assembly view from another angle of the lower portion of the window shade of the present invention.
Figure 11:
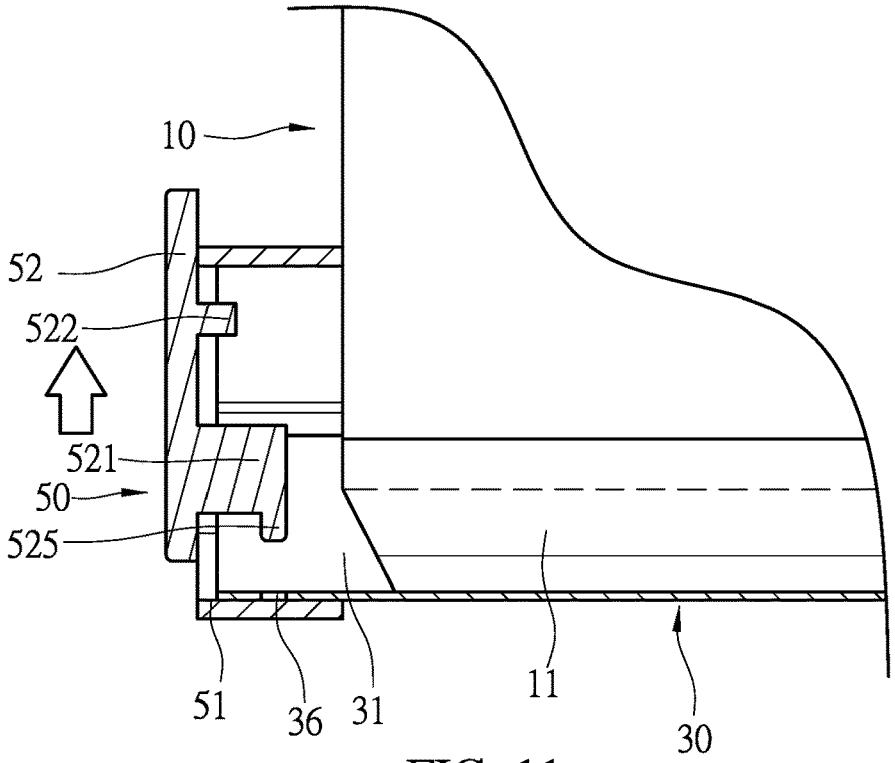
FIG. 11 is a partial sectional disassembly view of the lower portion of the window shade of the present invention.
Figure 12:
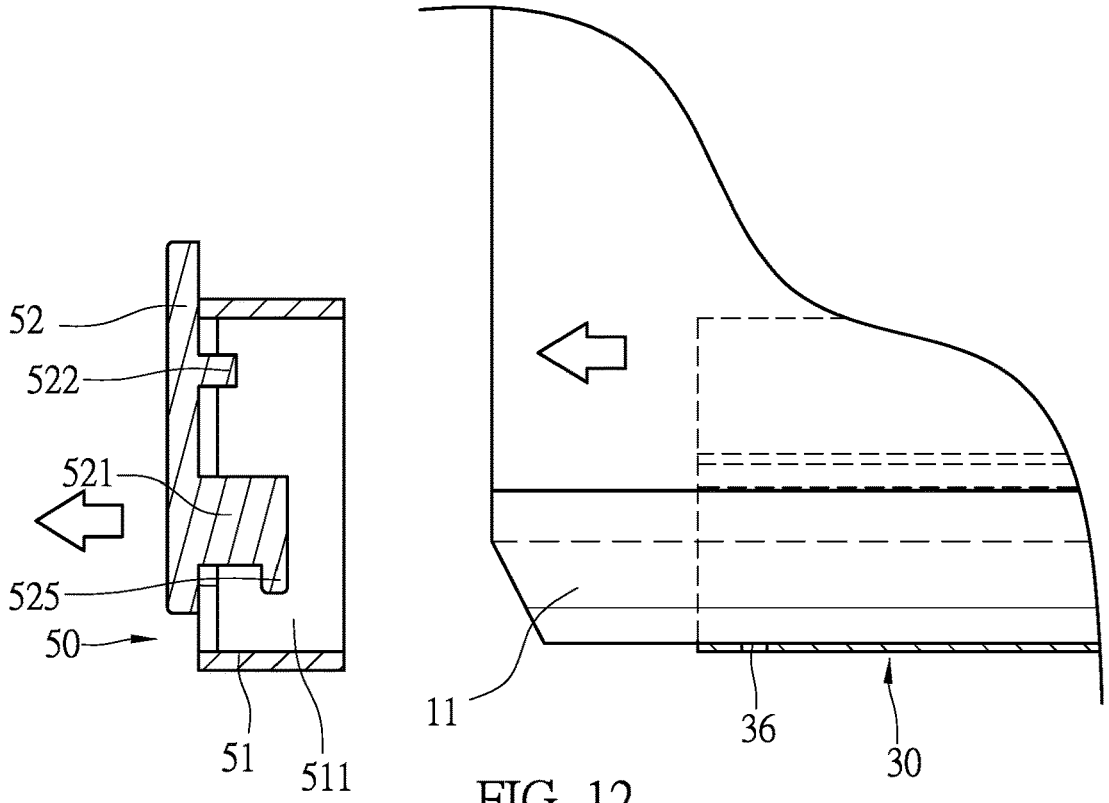
FIG. 12 is a sectional view illustrating a second blocking unit is detached from a weight track of the window shade of the present invention.
Figure 13:
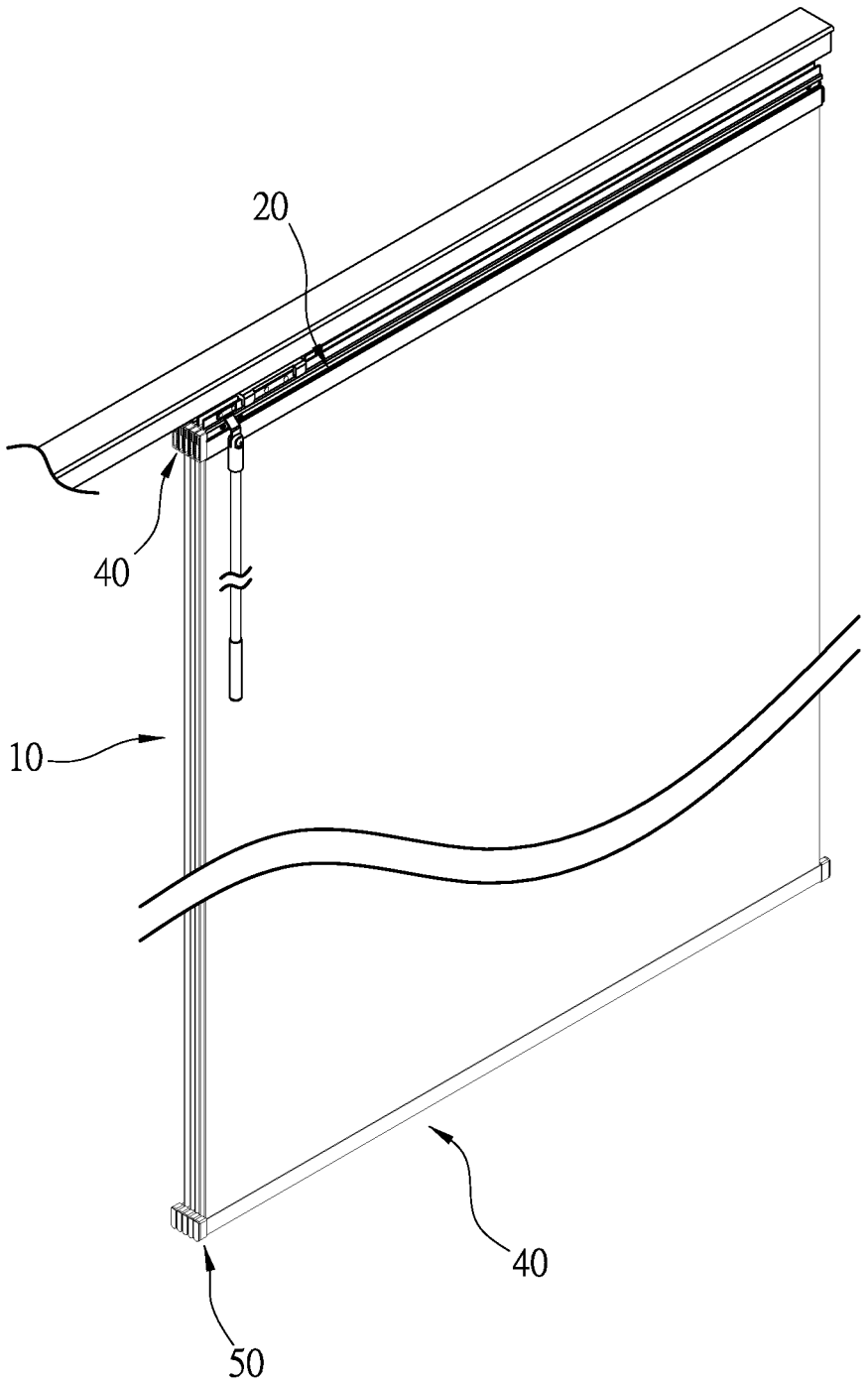
FIG. 13 is a schematic diagram of the window shade of the present invention in actual application.

In order to further understand the goal, characteristics and effect of the present invention, a number of embodiments along with the drawings are illustrated as following:

Referring to FIGS. 1 to 3, the present invention provides a window shade which comprises a shade (10), a sliding base (20), a weight track (30), a first blocking unit (40), and two second blocking units (50). Each of an upper end and a lower end of the shade (10) has a mount bar (11), and the thickness of the mount bar (11) is greater than that of the shade (10). A lateral side of the sliding base (20) comprises a first locating groove (21), and a shade groove (22) is formed at a bottom portion of the sliding base (20). The shade groove (22) is located under the first locating groove (21), and the mount bar (11) on the upper end of the shade (10) is adapted to be coupled in the shade groove (22). The weight track (30) is an elongated board having U-shape cross-section, and a connecting space (31) is formed therein, and the mount bar (11) on the lower end of the shade (10) is configured to be coupled in the connecting space (31). Each of two lateral sides of the weight track (30) has an abutting portion (32), and a top end of the abutting portion (32) is bent inwardly into an inverted U-shaped, and an inner leg of the inverted U is formed into a locating board (33), and each of the two locating boards (33) is sloped from top to bottom to enable two ends of the two locating boards (33) close to each other. Also, each of two buffering spaces (34) is formed between the locating board (33) and the abutting portion (32) to enable the abutting portion (32) to slightly expand outwardly, and the end of the locating board (33) is bent to form a clamping portion (35). Moreover, each of two ends of the connecting space (31) has a locating hole (36) formed at a bottom portion thereof. The first blocking unit (40) comprises a connecting block (41) and a first block (42), and an end of the connecting block (41) is coupled in the first locating groove (21) while the other end thereof comprises a first engaging portion (411). An end of the first engaging portion (411) has a first blocking portion (412) which is formed in triangular prism shape, and the first engaging portion (411) comprises a second blocking portion (413), and a second locating groove (414) is formed between the first blocking portion (412) and the second blocking portion (413). The thickness of the second locating groove (414) is smaller than that of the first blocking portion (412) and that of the second blocking portion (413). A connecting channel (421) penetrates the first block (42) from one end to the other end, and an outer end of the connecting channel (421), which is located far from the sliding base (20) than an inner end thereof, comprises a first groove (422), and a stepped second engaging portion (423) is formed between the connecting channel (421) and the first groove (422). An outer wall of the first block (42) comprises an uneven rough portion (424) to facilitate a user to pull the first block (42) up and down. Each of the second blocking units (50) comprises a cover (51) and a cover board (52), and one side of the cover (51) is concaved to form a covering space (511). The two covering spaces (511) are respectively disposed and coupled on two ends of weight track (30). Furthermore, each of the covers (51) comprises a through slot (512) at the side opposed to the covering space (511), and the through slot (512) is communicated with the covering space (511). The through slot (512) has two symmetric lateral walls therein, and two protruding portions (513) are respectively formed on the two lateral walls of the through slot (512). The cover board (52) comprises an engaging rib (521) and a locating protrude (522) which respectively protrude from a lateral side of the cover board (52). An end of the engaging rib (521) is tapered to form a third engaging portion (523), and a third locating groove (524) is formed between the third engaging portion (523) and the cover board (52), and an end of the third engaging portion (523) has an engaging bolt (525) protruding from a bottom portion thereof.

Structurally, referring to FIGS. 1 to 12, the sliding base (20) is installed on the mount bar (20) on the upper end of the shade (10) through the shade groove (22), and the first blocking unit (40) is coupled in the first locating groove (21). The first engaging portion (411) of the connecting block (41) of the first blocking unit (40) is coupled in the connecting channel (421) of the first block (42), and the first blocking portion (412) is adapted to pass through the connecting channel (421) and engage with the second engaging portion (423) at an outer side of the first block (42). Moreover, the second blocking portion (413) is abutted against an inner side of the first block (42), and the second locating groove (414) is limited in the connecting channel (421) such that the first block (42) is adapted to have vertical movement relative to the second locating groove (414) through the connecting channel (421). The end of the connecting block (41) other than the first engaging portion (411) is coupled in the first locating groove (21), and the movable first block (42) is adapted to be moved vertically to block or unblock the shade groove (22) at an end thereof. The weight track (30) is coupled on and covers the mount bar (20) on the lower end of the shade (10), and the mount bar (20) is positioned in the connecting space (31) between the two locating boards (33), and the two second blocking units (50) are respectively coupled on the two ends of weight track (30). The outer diameter of the covering space (511) of the cover (51) is smaller than that of the weight track (30) and each of the buffering spaces (34) is formed between the locating board (33) and the abutting portion (32) such that the abutting portions (32) on the two lateral sides of the weight track (30) are adapted to be pushed inwardly to enable the two covers (51) to dispose on the two ends of the weight track (30) respectively. Also, for single second blocking unit (50), the cover board (52) is adapted to couple with the cover (51), and the engaging rib (521) and the locating protrude (522) are respectively coupled in and movable along the through slot (512), and the engaging rib (521) is further inserted into the covering space (511), and the third engaging portion (523) penetrates through the through slot (512) and is secured. Meanwhile, the third locating groove (524) is slidably limited in the through slot (512), and the engaging bolt (525) is engaged with the locating hole (36) of the weight track (30), so as to secure the cover (51) on the weight track (30).

In actual application, referring to FIGS. 4 to 13, the window shade comprises a plurality of sliding bases (20) which can be driven one by one, and each of the shades (10) is installed on the sliding base (20), and the shade (10) is positioned by the first blocking unit (40). In case that the shade (10) is installed or uninstalled, the first block (42) is slid upwardly along the first engaging portion (411) to make the end of the shade groove (22) open, such that the shade (10) is adapted to be coupled in and moved out from the shade groove (22), and then the first block (42) is slid back to block the end of the shade groove (22) to complete installation and uninstallation. Moreover, the weight track (30) is installed on the mount bar (11) on the lower end of the shade (10), and the two second blocking units (50) are respectively installed on the two ends of the weight track (30). Each of the two second blocking units (50) has the cover (51), and the cover board (52) is coupled in the through slot (512) of the cover (51). When the cover board (52) is slid downwardly along the through slot (512), the engaging bolt (525) of the engaging rib (521) is adapted to engage with the locating hole (36) of the weight track (30), and the cover (51) is secured on the weight track (30) so as to improve the connection between the weight track (30) and the shade (10). On the other hand, in case that the shade (10) or the weight track (30) needs to be replaced, the cover board (52) is moved upwardly along the through slot (512), and the engaging bolt (525) is disengaged from the locating hole (36) such that the cover (51) can be detached from the weight track (30).

Comparing with conventional window shade, the present invention is advantageous because: with the first blocking unit (40) and the two second blocking units (50), the shade (10) can be replaced easily, and also the structural stability of the window shade is improved.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A window shade comprising a shade, a sliding base, a weight track, a first blocking unit, and two second blocking units;

wherein the shade has two mount bars respectively formed at an upper end and a lower end thereof;

wherein the sliding base comprises a first locating groove at a lateral side thereof, and a shade groove formed at a bottom portion of the sliding base is located under the first locating groove, and the mount bar on the upper end of the shade is adapted to be coupled in the shade groove;

wherein the weight track is an elongated board having U-shape cross-section, and a connecting space is formed therein, and the mount bar on the lower end of the shade is configured to be coupled in the connecting space; each of two ends of the connecting space has a locating hole formed at a bottom portion thereof;

wherein the first blocking unit comprises a connecting block and a first block, and an end of the connecting block is coupled in the first locating groove while the other end thereof comprises a first engaging portion; a connecting channel penetrates the first block from one end to the other end, and an outer end of the connecting channel comprises a first groove, and a stepped second engaging portion is formed between the connecting channel and the first groove; the connecting block is coupled with the first block, and the first engaging portion is slidably coupled in the connecting channel, and the first block is adapted to have vertical movement relative to the first engaging portion through the connecting channel, so as to enable the first block to block or unblock the shade groove at an end thereof; and wherein each of the second blocking units comprises a cover and a cover board, and one side of each cover is concaved to form a covering space, and each of the covering spaces is respectively disposed and coupled on each end of weight track; each of the covers comprises a through slot at the side opposed to each covering space, and the through slot of each cover is communicated with each covering space; each cover board comprises an engaging rib and a locating protrude which respectively protrude from a lateral side of each cover board, and an end of the engaging rib has an engaging bolt protruding from a bottom portion thereof; the engaging rib and the locating protrude are respectively coupled in and movable along the through slot of each cover, and the engaging rib is further inserted into each covering space; and the engaging bolt is engaged with each locating hole of the weight track, so as to secure each cover on the weight track.

2. The window shade of claim 1, wherein an end of the first engaging portion has a first blocking portion, and the first engaging portion comprises a second blocking portion separated from the first blocking portion, and a second locating groove is formed between the first blocking portion and the second blocking portion; the thickness of the second locating groove is smaller than that of the first blocking portion and that of the second blocking portion; the connecting block is connected to the first block, and the first blocking portion is adapted to pass through the connecting channel and engage with the second engaging portion at an outer side of the first block, and the second blocking portion is abutted against an inner side of the first block, and the second locating groove is limited in the connecting channel.

3. The window shade of claim 1, wherein an outer wall of the first block comprises an uneven rough portion to facilitate a user to pull the first block up and down.

4. The window shade of claim 1, wherein the elongated weight track has U-shape cross-section, and each of two lateral sides of the weight track comprises an abutting portion, and a top end of the abutting portion is bent inwardly into an inverted U-shaped, and an inner leg of the inverted U is formed into a locating board, and each locating board is sloped from top to bottom to enable two ends of the two locating boards close to each other; each of two buffering spaces is formed between each locating board and the abutting portion to enable the abutting portion to slightly expand outwardly, and the end of each locating board is bent to form a clamping portion.

5. The window shade of claim 1, wherein the through slot of each cover has two symmetric lateral walls therein, and two protruding portions are respectively formed on the two lateral walls of the through slot.

6. The window shade of claim 1, wherein an end of the engaging rib is tapered to form a third engaging portion, and a third locating groove is formed between the third engaging portion and each cover board.

* * * * *